United States Patent [19]

Williams

[11] 4,369,357

[45] Jan. 18, 1983

[54] RACE COMPUTER

[76] Inventor: Gloria J. Williams, P.O. Box 371, West Long Branch, N.J. 07764

[21] Appl. No.: 264,194

[22] Filed: May 15, 1981

[51] Int. Cl.[3] ..... G06G 1/00

[52] U.S. Cl. ..... 235/78 G; 235/88 G

[58] Field of Search ..... 235/78 R, 78 G, 88 R, 235/88 G, 70 R, 70 A, 116

[56] References Cited

U.S. PATENT DOCUMENTS 3,558,044 1/1971 Hitchings ..... 235/88 G

*Primary Examiner*—L. T. Hix

*Assistant Examiner*—Thomas H. Tarcza

[57] ABSTRACT

This computer device provides a system for selecting the winners of both horse and dog races, and it consists primarily of a stationary card, having a circular area, in which is imprinted the weights of the horses and dogs, as indicated on track programs. It further includes a rotatable disc, with openings to view the weights of horses and dogs, and the program "odds" are imprinted alongside of each of the openings, the bet selection being the lesser sum of the addition of each of the weights of the horses and the last figure of the "odds" on each horse, the same being applied to dog races.

3 Claims, 5 Drawing Figures

RACE COMPUTER

This invention relates to computer devices, and more particularly, to a race computer.

It is, therefore, the principal object of this invention to provide a race computer, which will be adapted for use at horse racing tracks and dog racing tracks.

Another object of this invention is to provide a race computer which will employ the use of four basic steps, as a means for determining what horse or dog to bet on, to win, etc.

Another object of this invention is to provide a race computer, which will be manually operated, by disc means, secured to a card, or a card and pad combination.

A further object of this invention is to provide a race computer, which will be of such size, that it may be easily carried in a pocket, or the purse of the user.

Other objects of the present invention are to provide a race computer, which is simple in design, inexpensive to manufacture, rugged in construction, easy to use and efficient in operation.

These, and other objects, will be readily evident, upon a study of the following specification, and the accompanying drawing, wherein.

Figure 1:
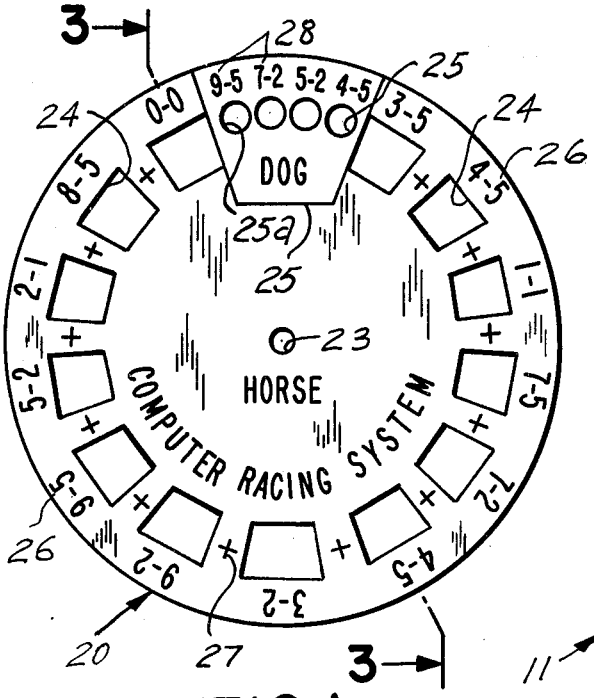
FIG. 1 is a top plan view of the rotatable disc of the present invention, shown removed from FIG. 2.
Figure 2:
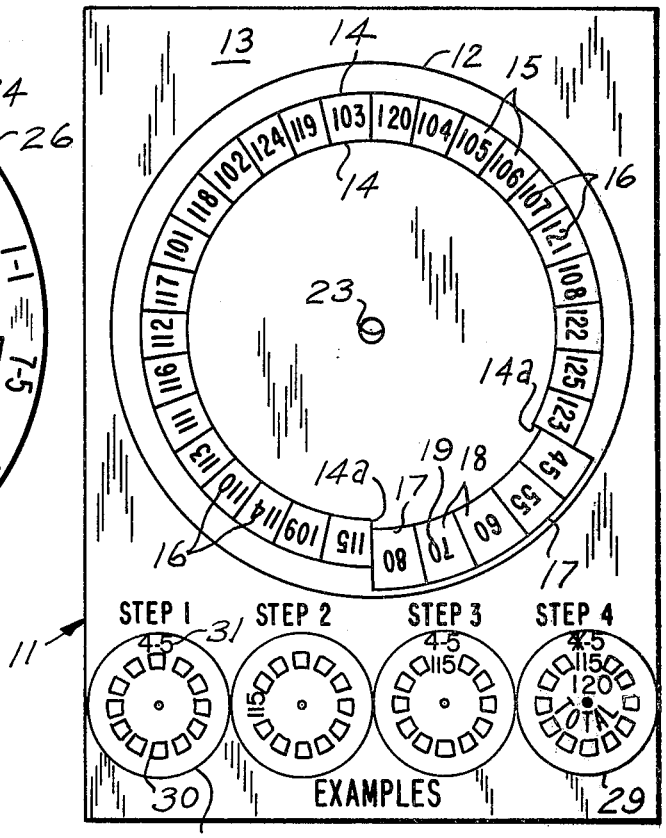
FIG. 2 is a top plan view of the base, or stationary member of the assembly, showing the disc of FIG. 1, removed therefrom.
Figure 3:
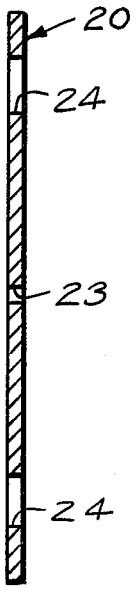
FIG. 3 is a cross-sectional view, taken along the line 3—3 of FIG. 1.
Figure 4:
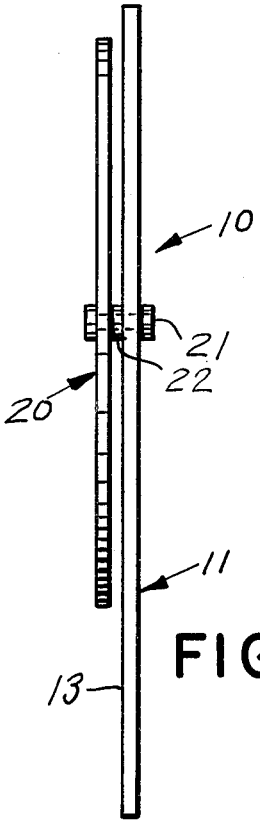
FIG. 4 is a right side elevational view of the assembly of FIGS. 1 and 2.
Figure 5:
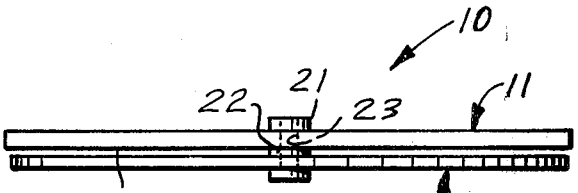
FIG. 5 is a top end view of the assembly of FIG. 4.

According to this invention, a race computer device 10 is shown to include a rectangular card 11, fabricated of plastic, or other suitable material. A circle 12, inscribed on the face 13 of card 11, provides border means, around a pair of split circles 14, on face 13, which defines adjacent and radial segments 15, in which are imprinted numerical characters 16, that serve to indicate the horse's weights, as are indicated on a typical racing program.

A pair of arcuate lines 17, inscribed on face 13, define a plurality of segments 18, which are located between the open portions 14*a*, and segments 18 are inscribed with dog weights, that are indicated by the numerical characters 19, for use at a dog racing track.

A rotatable disc 20 is secured to card 11, by means of a suitable rivet fastener 21, received in spacer 22, and openings 23 of card 11 and disc 20. A plurality of radially spaced-apart openings 24, through disc 20, provide a means of observing the numerical characters 16 on card 11, and a segment line 25, between a pair of openings 24, includes smaller openings 25*a*, for observing the numerical characters 19 of card 11, which indicate dog weights. Numerical characters 26, alongside of each opening 24 of disc 20, serve to indicate the various "odds" as imprinted on a horse racing program, and a plus sign 27 is inscribed between each of the openings 24, so as to indicate addition of factors, when using computer device 10. Similar numerical characters 28, alongside of openings 25*a*, serve as a means of indicating the various "odds," as associated with dog races. The word "DOG" is imprinted within segment line 25, and, also, the words "HORSE COMPUTER RACING SYSTEM" is imprinted on the larger portion of device 10, so as to indicate that device 10 is for use with both horses and dogs.

On the lower portion of face 13, of card 11, are inscribed four circles 29, with a plurality of boxes 30 and numerical characters 31 thereon, which serve as an aid in using device 10, and above the circles 29 are inscribed the "steps" from 1–4, that indicate the examples of the usage of device 10.

The four steps of operation, for using device 10, are as follows:

(1) The user locates the lowest "odds," indicated on the racing program, after which, he locates the similar "odds" on the device 10, such as, "4–5."

(2) Alongside of the above-mentioned "odds," on the racing program, will be found the "weight" of the horse, such as, "weight 115."

(3) On the device 10, rotate the disc 20, until the "odds" of that particular horse, as read on the disc 20, align even with the horse's "weight," which will be observed in the corresponding opening 14.

(4) Now, the second number of the "odds" is added, such as, the "5" of the (4–5); along with the weight of your horse. If the total amount, after adding, is less than any of the others in the race, then that is the horse you should bet on.

The above-mentioned four steps are also used, when betting at a dog track, however, the "dog weights" are read in the smaller openings 25*a* of device 10.

It shall be noted, that device 10 will be used with a pad, that is optional, or may be fabricated as part of device 10.

It is also important, that this invention should be used on all of the horses, or dogs, in their respective races, and, when obtaining the lowest total amount for a particular race, the user should put that horse or dog on a "place" bet.

It shall be recognized, that the weights of the horses and dogs indicated on the computer device 10, and the respective racing programs are weights placed on the horses and dogs.

While various changes may be made in the detail construction, it is understood that such changes will be within the spirit and scope of the present invention, as is defined by the appended claims.

What is claimed as new is:

1. A race computer for horses and dogs, comprising, in combination, a rectangular card, a plurality of adjacent segments arranged in a circular configuration imprinted on said card, a portion of said segments indicating the weights of horses imprinted on a horse race program, and another portion of said segments indicating the weights of dogs imprinted on a dog race program, a rotatable disc secured to said card by suitable means, race track odds included on said rotatable disc, providing for alignment with said weights of horses imprinted on said portion of said segments on said card, and said weights of said horses on said card, when aligned with said race track odds on said disc, are added by the user to obtain a total for each horse running in a particular race, and the lowest total obtained, of all of said horses to be run in said race, is the horse for said user to place a bet on.

2. The combination according to claim 1, wherein said circular configuration, inscribed on said card, comprises a border circle, in which is inscribed a pair of split circles, which define said plurality of adjacent segments, in which are imprinted the various said weights of horses.

3. The combination according to claim 2, wherein the open area of said pair of split circles includes said another portion of segments, which indicate said dog weights, and said segments indicating said dog weights provide continuity with the open area in said pair of split circles, and said rotatable disc is secured in the center of said pair of circles, by rivet fastener means, through a central opening of said disc, and said card, and said disc includes a plurality of radially spaced-apart openings, for viewing said weights of horses imprinted within said segments of said pair of circles, and said odds of said horse racing program are imprinted alongside of said openings, and a plus sign is imprinted between each of said openings, to indicate addition, and a segment line is imprinted between a pair of the openings of said disc, and a plurality of smaller openings, through the area defined by said segment line, includes numerical characters alongside of each of said smaller openings indicating dog odds, and the weights of dogs of said card are viewed within said smaller openings.

* * * * *

UNITED STATES PATENT AND TRADEMARK OFFICE

CERTIFICATE OF CORRECTION

PATENT NO. : 4,369,357

DATED : January 18, 1983

INVENTOR(S) : Gloria J. Williams

It is certified that error appears in the above-identified patent and that said Letters Patent are hereby corrected as shown below:

DELETE "horses" and substitute therefor "jockey's" in:

Abstract, lines 4, 7 and 10;

Column 1, line 44;

Column 2, lines 17, 20, 24, 39, 52, 57 and 59;

Column 3, lines 2 and 12.

Signed and Sealed this

Twentieth Day of March 1984

[SEAL]

*Attest:*

*Attesting Officer*

GERALD J. MOSSINGHOFF

*Commissioner of Patents and Trademarks*